US008337055B2

(12) United States Patent
Clifton et al.

(10) Patent No.: US 8,337,055 B2
(45) Date of Patent: Dec. 25, 2012

(54) RECESSED LIGHTING FIXTURE WITH TAMPER-RESISTANT BEZEL ASSEMBLY

(75) Inventors: David Wiley Clifton, Conyers, GA (US); Leslie Charles King, Loganville, GA (US)

(73) Assignee: ABL IP Holding LLC, Conyers, GA (US)

( * ) Notice: Subject to any disclaimer, the term of this patent is extended or adjusted under 35 U.S.C. 154(b) by 285 days.

(21) Appl. No.: 12/750,047

(22) Filed: Mar. 30, 2010

(65) Prior Publication Data

US 2010/0246193 A1 Sep. 30, 2010

Related U.S. Application Data

(60) Provisional application No. 61/164,512, filed on Mar. 30, 2009.

(51) Int. Cl.
*F21V 17/10* (2006.01)

(52) U.S. Cl. ..... 362/362; 362/365; 362/433; 362/455; 362/147

(58) Field of Classification Search ..... 362/362, 362/364, 365, 367, 376, 433, 441, 455, 456, 362/147, 148
See application file for complete search history.

(56) References Cited

U.S. PATENT DOCUMENTS

| | | | | | |
|---|---|---|---|---|---|
| 1,846,813 | A | * | 2/1932 | Pfeiffer | 362/363 |
| 2,172,248 | A | * | 9/1939 | Kost | 362/455 |
| 2,741,695 | A | * | 4/1956 | Schockett | 362/294 |
| 3,130,949 | A | * | 4/1964 | Wolff et al. | 362/365 |
| 3,268,721 | A | * | 8/1966 | Dworkin et al. | 362/364 |
| 3,313,931 | A | * | 4/1967 | Klugman | 362/366 |
| 3,962,675 | A | * | 6/1976 | Rowley et al. | 362/101 |
| 4,344,114 | A | * | 8/1982 | Denhart | 362/147 |
| 4,685,037 | A | * | 8/1987 | Akiyama et al. | 362/276 |
| 5,083,248 | A | | 1/1992 | Troy | |
| 5,309,342 | A | * | 5/1994 | Heinen, Sr. | 362/364 |
| 5,373,431 | A | | 12/1994 | Hayman et al. | |
| 5,465,199 | A | | 11/1995 | Bray et al. | |
| 5,597,234 | A | | 1/1997 | Winkelhake | |
| 5,662,413 | A | | 9/1997 | Akiyama | |
| 5,673,997 | A | | 10/1997 | Akiyama | |
| 5,826,970 | A | | 10/1998 | Keller et al. | |
| 5,934,788 | A | | 8/1999 | Wolfe | |
| 5,951,151 | A | | 9/1999 | Doubeck et al. | |
| 6,030,102 | A | | 2/2000 | Gromotka | |
| 6,045,241 | A | | 4/2000 | Pahl | |
| 6,095,671 | A | | 8/2000 | Hutain | |
| 6,164,802 | A | | 12/2000 | Gromotka | |
| 6,474,846 | B1 | | 11/2002 | Kelmelis et al. | |
| 6,719,438 | B2 | | 4/2004 | Sevack et al. | |
| 6,957,896 | B2 | | 10/2005 | Burgess | |
| 7,121,696 | B2 | | 10/2006 | Whitfield, Sr. | |
| 7,186,008 | B2 | | 3/2007 | Patti | |
| 7,198,391 | B2 | | 4/2007 | Rutchik | |
| 7,222,979 | B1 | | 5/2007 | Popowich et al. | |
| 7,399,104 | B2 | * | 7/2008 | Rappaport | 362/365 |
| 2002/0008975 | A1 | * | 1/2002 | Uedono et al. | 362/376 |
| 2007/0019418 | A1 | | 1/2007 | Czech et al. | |

(Continued)

*Primary Examiner* — Ismael Negron
(74) *Attorney, Agent, or Firm* — Kilpatrick Townsend & Stockton LLP

(57) ABSTRACT

A lighting fixture generally includes a mounting plate, a ceiling bracket, a reflector that houses a light source, and a bezel assembly. The ceiling bracket is supported on the ceiling by the mounting plate via the use of retainer brackets. The bezel assembly in turn is supported on the ceiling by the ceiling bracket. The bezel assembly includes a bezel housing and at least one tamper-resistant lens mounted in the housing.

16 Claims, 4 Drawing Sheets

U.S. PATENT DOCUMENTS

2007/0058374 A1 3/2007 Dupre
2007/0076441 A1 4/2007 Zampini et al.
2007/0183154 A1 8/2007 Robson
2008/0112170 A1 5/2008 Trott et al.
2008/0180961 A1 7/2008 Gibson et al.
2008/0192489 A1 8/2008 Ward
2008/0198606 A1 8/2008 Goto
2008/0198607 A1 8/2008 Goto
2008/0285271 A1 11/2008 Roberge et al.
2009/0052194 A1* 2/2009 Jowid ..... 362/351
2009/0086476 A1 4/2009 Tickner et al.

* cited by examiner

RECESSED LIGHTING FIXTURE WITH TAMPER-RESISTANT BEZEL ASSEMBLY

CROSS REFERENCE TO RELATED APPLICATION

This application claims the benefit of U.S. Provisional patent application Ser. No. 61/164,512, filed Mar. 30, 2009, which is incorporated herein by this reference.

TECHNICAL FIELD

The present application relates to recessed lighting fixtures, and more particularly to a recessed lighting fixture that provides protection against vandalism of, or tampering with, the fixture.

BACKGROUND

Recessed lighting fixtures are a popular lighting application for many different residential and commercial applications. In a typical recessed lighting fixture, a reflector contains a light source such as an incandescent or compact fluorescent light bulb.

Despite the popularity of these fixtures, the light source is susceptible to damage from vandals or from accidental contact with the light source, particularly where the fixtures are used in commercial applications. For environmental and health reasons, damage is of particular concern where mercury-containing compact fluorescent light bulbs are used.

Accordingly, it would be desirable to have a recessed lighting fixture that includes protection against intentional or accidental damage from external forces.

SUMMARY

Embodiments of the invention provide lighting fixtures provided with trim assemblies that prevent a vandal from rendering the fixtures inoperative or otherwise damaging or tampering with the fixtures, and further provides protection against damage due to accidental contact with the fixture. The fixtures generally include a mounting plate, a ceiling bracket, a reflector that houses a light source, and a bezel assembly. The ceiling bracket is supported on the ceiling by the mounting plate via the use of retainer brackets. The bezel assembly in turn is supported on the ceiling by the ceiling bracket. The bezel assembly includes a bezel housing and at least one tamper-resistant lens mounted in the housing. The bezel assembly serves to cover and protect the light fixture, particularly the light source housed in the fixture, from damage caused by intentional or accidental external forces.

DETAILED DESCRIPTION

Figure 1:
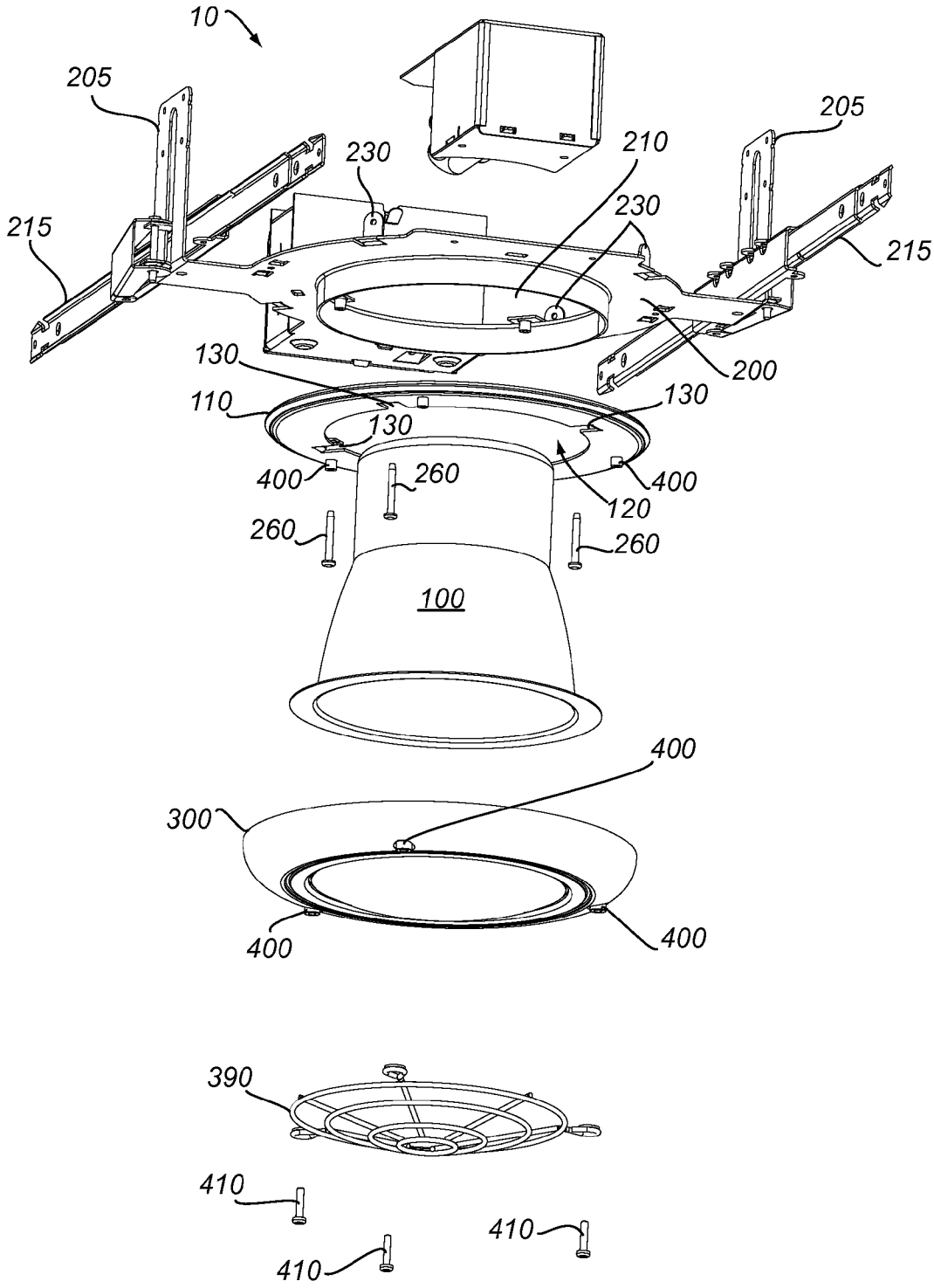
FIG. 1 is an exploded view of a recessed lighting fixture according to one embodiment of the invention.
Figures 2, 2A:
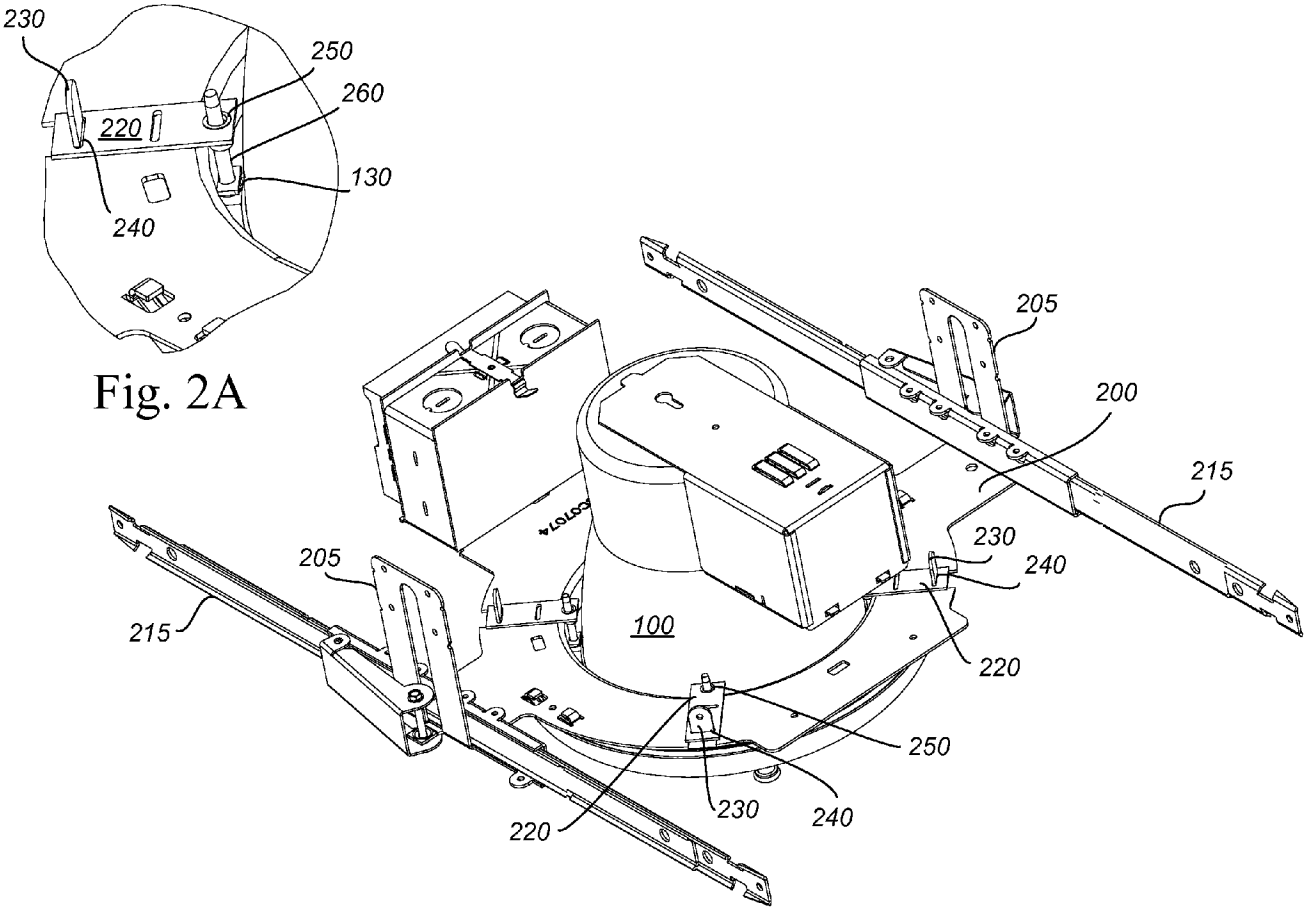
FIG. 2 is a top perspective view of a recessed lighting fixture according to an embodiment of the invention.
FIG. 2A is a close-up view of an aspect of the embodiment of FIG. 2.

An embodiment of the recessed lighting fixture 10 is shown in FIGS. 1 and 2. The lighting fixture 10 generally includes a mounting plate 200 having a mounting plate aperture 210, a ceiling bracket 110 having a ceiling bracket aperture 120, a reflector 100 which houses a light source (not shown), and a bezel assembly 300. During installation, the mounting plate 200 is suspended between adjacent ceiling joists in a conventional way (such as through the use of mounting structures 205 with our without the use of suspension bars 215). The ceiling bracket 110 is positioned on the ceiling opposite the mounting plate 200 and attached to the mounting plate 200 (as discussed in more detail below) so that the mounting plate aperture 210 and the ceiling bracket aperture 120 align. The reflector 100 is then inserted through the ceiling bracket aperture 120 and mounting plate aperture 210 and may be retained therein using clips or other traditional fixation methods (not shown but all well know in the industry). Finally, the bezel assembly 300 is mounted to the ceiling bracket 110 (as discussed in detail below) to complete installation.

To position and secure the ceiling bracket 110 on the ceiling, the ceiling bracket 110 is positioned flush with the exposed ceiling so that the ceiling bracket aperture 120 aligns with the mounting plate aperture 210 and subsequently secured to the mounting plate 200. A gasket (not shown) may be provided on the ceiling bracket 110 so as to be positioned between the ceiling bracket 110 and ceiling when the ceiling bracket 110 is installed. The gasket provides a water and dust tight seal between the ceiling bracket 110 and the ceiling.

Retainer brackets 220 may be used to facilitate proper positioning of the ceiling bracket 110 relative to the mounting plate 200 and to secure the ceiling bracket 110 on the ceiling. As best seen in FIGS. 2 and 2A retainer bracket 220 includes at least one slot 240 and a retainer bracket aperture 250. A slot 240 receives an upstanding arm 230 on the mounting plate 200 to correctly position the retainer bracket 220 on the mounting plate 200 so that a plate mounting aperture 130 (see FIGS. 1 and 2A) on the ceiling bracket 110 and retainer bracket aperture 250 on the retainer bracket 220 align. Note that the slots 240 in the retainer brackets 220 are shown in the figures as having upstanding arms 230 inserted therethrough. See, in particular, FIG. 2A for a more detailed view of this interaction.

Upon such alignment, screws 260 may be inserted through the plate mounting aperture 130 on the ceiling bracket 110 and retainer bracket aperture 250 on the retainer bracket 220 to secure the ceiling bracket 110 to the mounting plate 200 indirectly via the retainer bracket 220. In this way, the mounting plate 200 supports the ceiling bracket 110 on the ceiling. Nut inserts (not shown) may be positioned in the plate mounting aperture 130 or retainer bracket aperture 250. Alternatively, nuts (not shown) separate from the plate mounting aperture 130 and/or retainer bracket aperture 250 may be used. Note that the retainer bracket apertures 250 are shown in the figures as having screws 260 inserted therethrough. See, in particular, FIG. 2A for an more detailed view of this interaction.

As discussed, the mounting plate 200 may be secured in position relative to the ceiling bracket 110 in a variety of ways all well known to those of skill in the art, and the present invention is not limited to the disclosed mounting configuration. The mounting plate 200, ceiling bracket 110 and retainer brackets 220 may be formed of any material having suitable integrity and strength to withstand the weight of the bezel assembly, including polymeric and metallic materials. In one embodiment, one or more of the mounting plate 200, ceiling bracket 110 and retainer brackets 220 are formed from galvanized steel. Moreover, while the retainer brackets 220 are shown as separate from the mounting plate 200 and ceiling bracket 110, they certainly could be integrally-formed with either. Moreover, apertures 250 could be formed directly on the mounting plate 200 so that one need only align the plate mounting apertures 130 of the ceiling bracket 110 with the apertures 250 and use fasteners to secure the mounting plate 200 and ceiling bracket 110 together.

Figure 3:
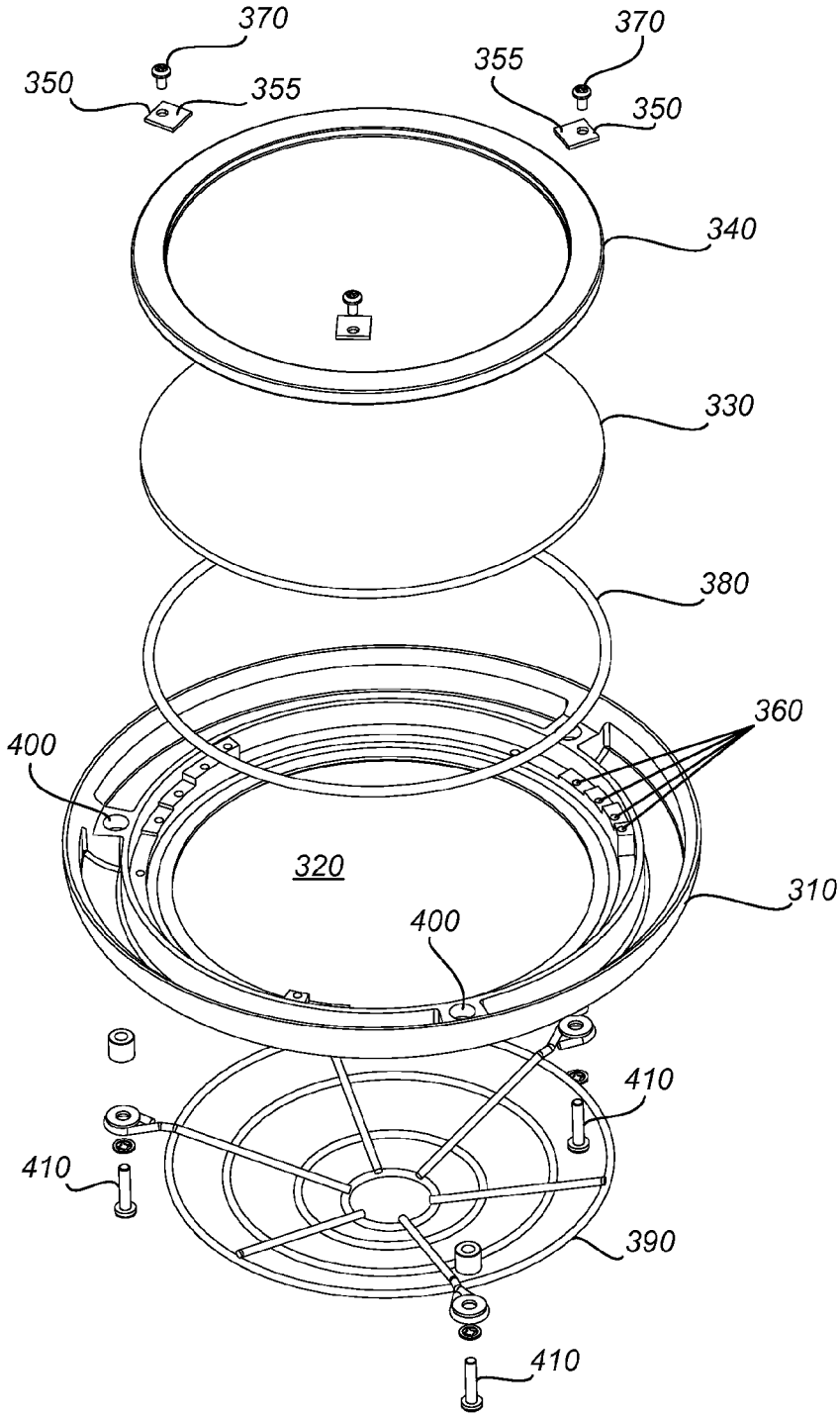
FIG. 3 is an exploded view of a bezel assembly according to one embodiment of the invention.
Figure 4:
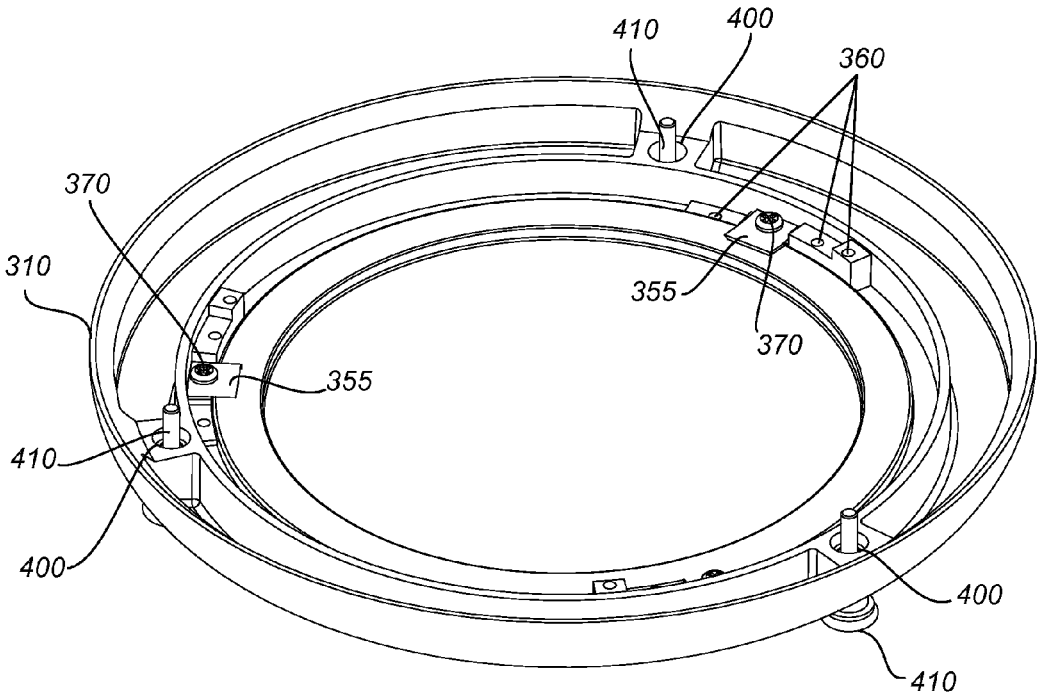
FIG. 4 is a perspective view of a bezel assembly according to an embodiment of the invention.

As shown in FIGS. 3 and 4, the bezel assembly 300 is mounted on the ceiling bracket 110. The bezel assembly 300 typically includes a bezel housing 310 having a central aperture 320 that accepts various decorative and/or vandal resistant lenses. The bezel housing 310 may be formed of any material but preferably is formed of a material having sufficient strength to withstand an assault or other external contacting force. In one embodiment, the bezel housing 310 is formed from a metallic material such as aluminum. The bezel housing 310 may be formed or treated to have desired decorative properties. For example, it can be painted with multiple paint finishes as well as plate finishes. It can be contoured as desired and its surface enhanced to impart the desired aesthetic.

At least one lens is retained within the bezel housing. In one embodiment illustrated in FIGS. 3 and 4 two lenses 330, 340 are retained within the bezel housing 310. It will be understood, however, that only one lens, or more than two lenses, could be used. By way only of example, lens 330 could be a polycarbonate lens and lens 340 could be a prismatic lens. The lenses 330, 340 are positioned in the central aperture 320 of the bezel housing 310 and can be secured in the housing in a variety of ways. In one embodiment, clips 350 having tongues 355 are used to secure the lenses 330, 340 against lens mounting apertures 360 in the bezel housing 310. The lens mounting apertures 360 (preferably but not necessary equipped with nut inserts) are positioned around the periphery of the central aperture 320. The clips 350 are aligned with the lens mounting apertures 360 on the bezel housing 310 and secured to the bezel housing 310 with screws 370 (such as, but not limited to, tamper resistant hexalobular internal drive screws such as Torx®-pin drive screws) such that the tongues 355 of the clips 350 extend into the central aperture 320 and capture the edge of the lens 330, 340 between the bezel housing and tongues of the clips. As configured in this manner, the screws 370 and clips 350 are located between the ceiling bracket 110 and the bezel housing 310 such that the screws 370 and clips 350 are not accessible from the exterior of the lighting fixture 10.

Lens mounting apertures 360 can be provided around the periphery of the bezel housing 310 in a step-like fashion to accommodate variable thicknesses of lens combinations. Moreover, a gasket 380 (such as a sponge rubber o-ring) may be positioned between the bezel housing 310 and lens 330, 340 to provide a water and dust tight seal between the bezel housing 310 and the lens 330, 340.

The at least one lens 330, 340 may be formed of any suitable material but preferably is formed from a material having sufficient integrity to withstand attack, such as various polycarbonate and glass lens options. Other accessories, such as a convex lens, a wire guard 390, and other decorative/functional fittings can optionally be retained on or in the bezel housing.

Bezel mounting apertures 400 are provided in the bezel housing 310 and the ceiling bracket 110. The bezel assembly 300 is mounted on the ceiling bracket 110 via any mechanical retention means. In one embodiment, screws 410 (such as, but not limited to, tamper resistant hexalobular internal drive screws such as Torx®-pin drive screws) extend through the bezel mounting apertures 400 of the bezel housing 310 and ceiling bracket 110. Nut inserts (not shown) may be positioned in the bezel mounting apertures 400 of the bezel housing 310 or the ceiling bracket 110.

The lighting assembly can be retrofitted to existing fixtures in the field or assembled on new fixtures prior to installation according to known methods.

The lighting fixture 10 described herein thus includes one or more features to protect the fixture and prevent a vandal from rendering the recessed lighting fixture inoperative or otherwise damaging or tampering with the fixture, and further provides protection against damage due to accidental contact with the fixture.

The foregoing is provided for purposes of illustrating, explaining, and describing embodiments of the present invention. Further modifications and adaptations to these embodiments will be apparent to those skilled in the art and may be made without departing from the scope or spirit of the invention.

We claim:

1. A lighting fixture comprising a mounting plate comprising a mounting plate aperture and at least one upstanding arm;

a ceiling bracket comprising a ceiling bracket aperture, wherein the ceiling bracket is supported by the mounting plate so that the mounting plate aperture and the ceiling bracket aperture substantially align, the ceiling bracket further comprising at least one plate mounting aperture for receiving a fastener;

a reflector positioned within the mounting plate aperture and the ceiling bracket aperture;

a bezel assembly comprising at least one tamper-resistant lens, wherein the bezel assembly is mounted on the ceiling bracket; and at least one retainer bracket comprising at least one slot for engaging the upstanding arm and at least one retainer bracket aperture for receiving the fastener.

2. The lighting fixture of claim 1, further comprising a gasket positioned between the ceiling bracket and mounting plate.

3. The lighting fixture of claim 1, wherein the ceiling bracket, mounting plate or at least one retainer bracket comprises steel.

4. The lighting fixture of claim 1, wherein the at least one tamper-resistant lens comprises polycarbonate or glass.

5. The lighting fixture of claim 1, wherein the bezel assembly comprises a plurality of lenses and wherein at least one of the plurality of lenses comprises the at least one tamper-resistant lens.

6. The lighting fixture of claim 1, wherein the bezel assembly further comprises a bezel housing.

7. The lighting fixture of claim 6, wherein the bezel assembly comprises aluminum.

8. The lighting fixture of claim 6, wherein the bezel assembly further comprises a wire guard mounted to the bezel housing.

9. The lighting fixture of claim 6, wherein the bezel assembly further comprises at least one gasket located between the bezel housing and the at least one tamper-resistant lens.

10. The lighting fixture of claim 6, further comprising at least one fastener securing the bezel assembly to the ceiling bracket.

11. The lighting fixture of claim 10, wherein the fastener is a hexalobular internal drive screw.

12. The lighting fixture of claim 6, further comprising at least one fastener securing the at least one tamper-resistant lens to the bezel housing.

13. The lighting fixture of claim 12, wherein the bezel housing comprises a plurality of lens mounting apertures for receiving the at least one fastener and wherein at least some of the plurality of lens mounting apertures are provided at different depths around a periphery of the bezel housing so as to accommodate varying thicknesses of lenses.

14. The lighting fixture of claim 12, wherein the at least one fastener comprises a clip and a screw.

15. The lighting fixture of claim 14, wherein the screw and clip are located between the ceiling bracket and the bezel housing such that the screw and clip are not accessible from the exterior of the lighting fixture.

16. A lighting fixture, comprising a mounting plate comprising a mounting plate aperture;

a ceiling bracket comprising a ceiling bracket aperture, wherein the ceiling bracket is supported by the mounting plate by a plurality of retainer brackets so that the mounting plate aperture and the ceiling bracket aperture substantially align;

a reflector positioned within the mounting plate aperture and the ceiling bracket aperture; and a bezel assembly mounted on the ceiling bracket and comprising a bezel housing and at least one tamper-resistant lens, wherein the mounting plate comprises a plurality of upstanding arms, the ceiling bracket comprises a plurality of plate mounting apertures for receiving a screw, and each of the plurality of retainer brackets comprises a slot for engaging each of the upstanding arms and a retainer bracket aperture for receiving the screw, and wherein the bezel housing comprises a plurality of lens mounting apertures for receiving at least one fastener and wherein at least some of the plurality of lens mounting apertures are provided at different depths around a periphery of the bezel housing so as to accommodate varying thicknesses of lenses.

* * * * *